US008453284B2

(12) United States Patent
Stoltz

(10) Patent No.: US 8,453,284 B2
(45) Date of Patent: Jun. 4, 2013

(54) SWIMMING POOL CLEANER

(75) Inventor: Herman Stoltz, Port Elizabeth (ZA)

(73) Assignee: Zodiac Pool Care South Africa (Pty) Limited (ZA)

( * ) Notice: Subject to any disclaimer, the term of this patent is extended or adjusted under 35 U.S.C. 154(b) by 551 days.

(21) Appl. No.: 12/525,865

(22) PCT Filed: Feb. 6, 2007

(86) PCT No.: PCT/IB2007/050385

§ 371 (c)(1),
(2), (4) Date: Jan. 25, 2010

(87) PCT Pub. No.: WO2008/096205

PCT Pub. Date: Aug. 14, 2008

(65) Prior Publication Data

US 2010/0139017 A1 Jun. 10, 2010

(51) Int. Cl.
*E04H 4/16* (2006.01)

(52) U.S. Cl.
USPC ..... 15/1.7; 210/167.16

(58) Field of Classification Search
USPC ..... 15/1.7, 404, 419; 137/527.8; 210/167.16, 210/167.17; 285/272
See application file for complete search history.

(56) References Cited

U.S. PATENT DOCUMENTS

| | | | | |
|---|---|---|---|---|
| 3,481,250 | A * | 12/1969 | Toby | 91/232 |
| 4,023,227 | A | 5/1977 | Chauvier | |
| 4,133,068 | A | 1/1979 | Hofmann | |
| 4,169,848 | A * | 10/1979 | Komai et al. | 554/108 |
| 4,208,752 | A * | 6/1980 | Hofmann | 15/1.7 |
| 4,351,077 | A * | 9/1982 | Hofmann | 15/1.7 |
| 4,642,833 | A | 2/1987 | Stoltz et al. | |
| 4,742,593 | A | 5/1988 | Kallenbach | |
| 4,769,867 | A * | 9/1988 | Stoltz | 15/1.7 |
| 5,226,205 | A * | 7/1993 | Pearce | 15/1.7 |
| 5,384,928 | A * | 1/1995 | Khoury | 15/1.7 |
| 5,418,994 | A * | 5/1995 | Rissik et al. | 15/1.7 |
| 5,469,596 | A * | 11/1995 | Rief et al. | 15/1.7 |
| 5,655,246 | A * | 8/1997 | Chang | 15/1.7 |
| 5,706,504 | A * | 1/1998 | Atkinson et al. | 1/1 |
| 5,775,741 | A * | 7/1998 | Rice et al. | 285/272 |
| 5,794,293 | A * | 8/1998 | Hoffinger | 15/1.7 |
| 6,098,228 | A * | 8/2000 | Chang | 15/1.7 |
| 6,226,826 | B1 | 5/2001 | Rice et al. | |
| 6,237,175 | B1 * | 5/2001 | Phillipson et al. | 15/1.7 |
| 6,298,513 | B1 * | 10/2001 | Rief et al. | 15/1.7 |
| 6,311,353 | B1 * | 11/2001 | Phillipson et al. | 15/1.7 |
| 6,473,928 | B1 * | 11/2002 | Veloskey et al. | 15/1.7 |
| 6,662,394 | B2 * | 12/2003 | Balint | 15/1.7 |
| 6,834,410 | B2 * | 12/2004 | Phillipson et al. | 15/1.7 |
| 6,966,092 | B2 * | 11/2005 | Sebor | 15/1.7 |

(Continued)

FOREIGN PATENT DOCUMENTS

| | | |
|---|---|---|
| EP | 0 721 033 A2 * | 7/1996 |
| GB | 2005993 | 5/1979 |

*Primary Examiner* — Robert Canfield
(74) *Attorney, Agent, or Firm* — Dean W. Russell; Kilpatrick Townsend & Stockton LLP

(57) ABSTRACT

A suction powered swimming pool cleaner connected to the filtration pump by a hose of varying length according to the size of the pool that need be cleaned. Unit comprises of a interruption type valve member moving forward in a stepwise manner thereby cleaning the pool surface. Valve oscillation and debris controlled by means of a flow-control-debris-diverter with aided waterbuffer technology for quiet operation.

8 Claims, 4 Drawing Sheets

U.S. PATENT DOCUMENTS

| | | | | |
|---|---|---|---|---|
| 7,108,293 | B2 * | 9/2006 | Van Der Meijden et al. | 285/275 |
| 7,159,263 | B2 * | 1/2007 | Sebor | 15/1.7 |
| 7,401,372 | B2 | 7/2008 | Sebor | |
| 2002/0116772 | A1 * | 8/2002 | Phillipson et al. | 15/1.7 |
| 2004/0103489 | A1 * | 6/2004 | Niewiarowski | 15/1.7 |
| 2008/0276388 | A1 * | 11/2008 | Dodd | 15/1.7 |
| 2009/0089945 | A1 * | 4/2009 | Chandler | 15/1.7 |

* cited by examiner

Fig 1
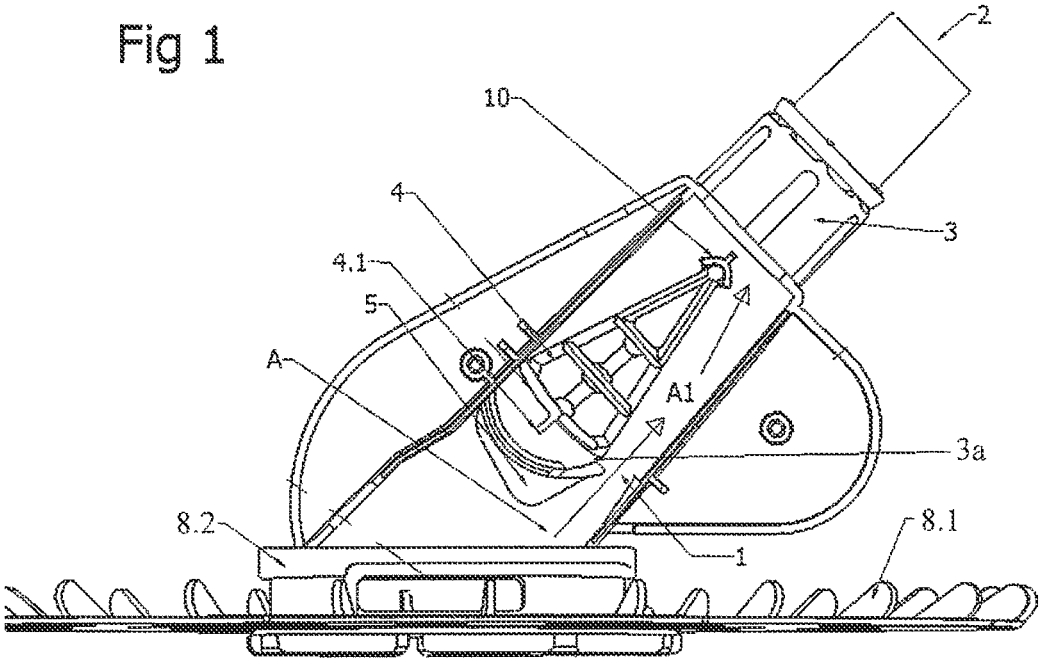
FIG 2A
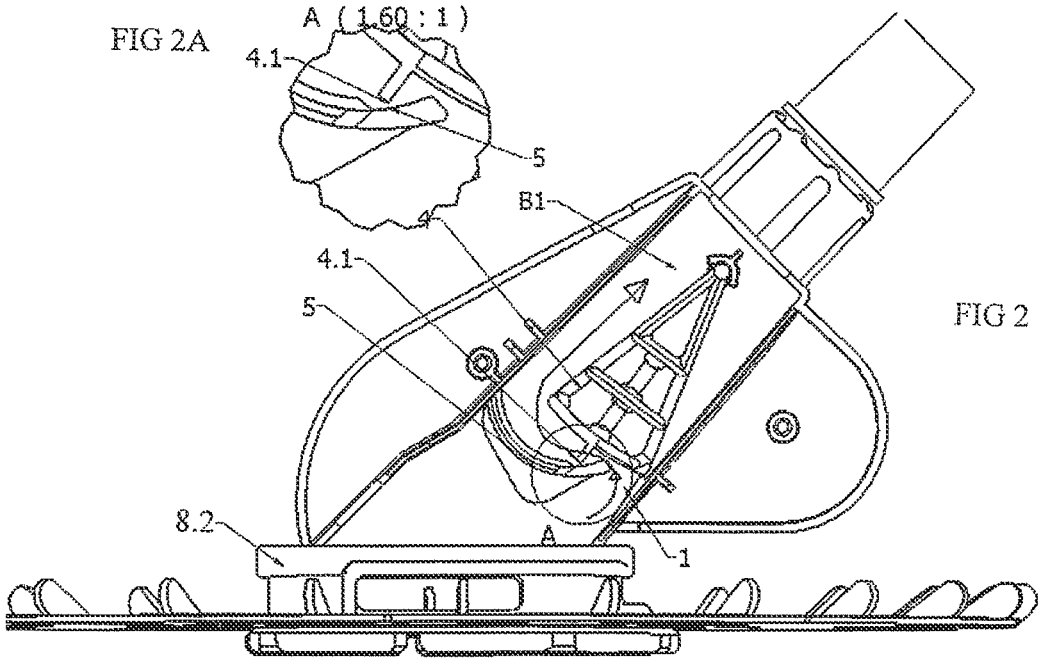
FIG 2

Fig 3
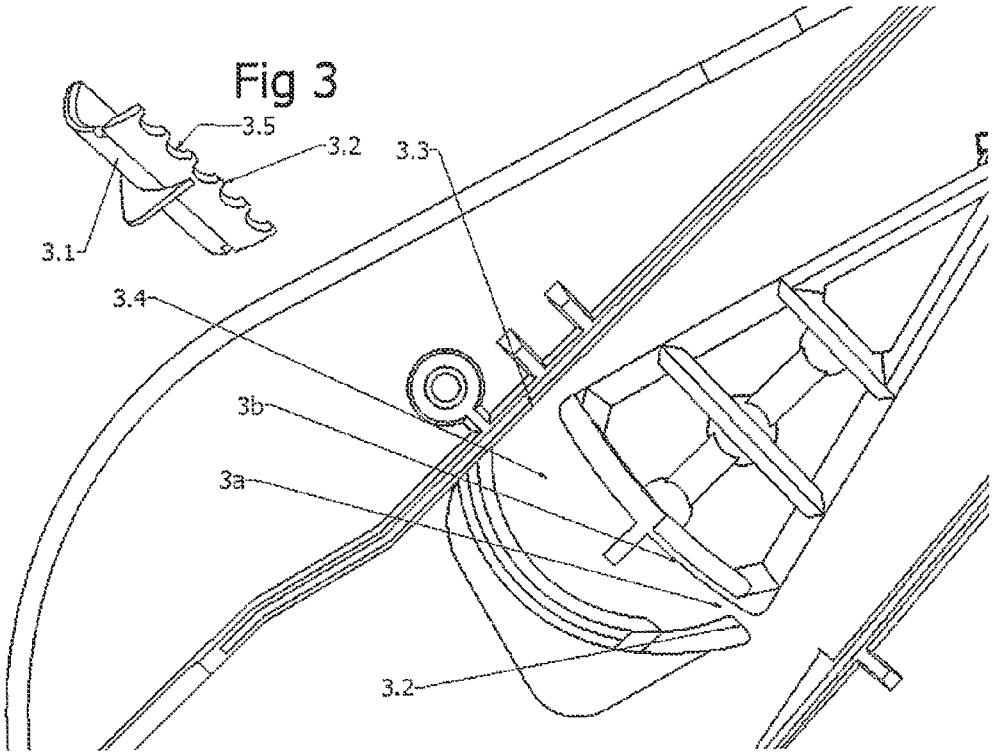
FIG 3A
Fig 4
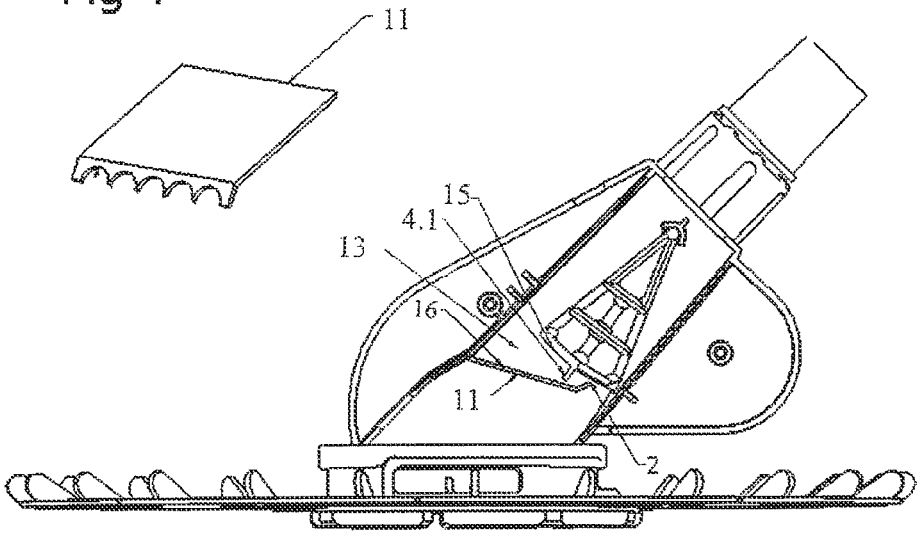
FIG 4A

FIG 5A
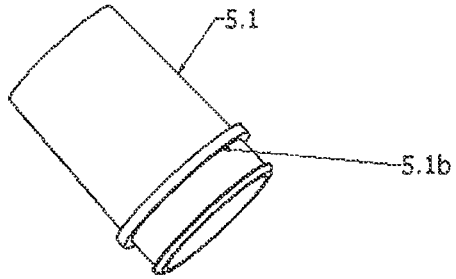
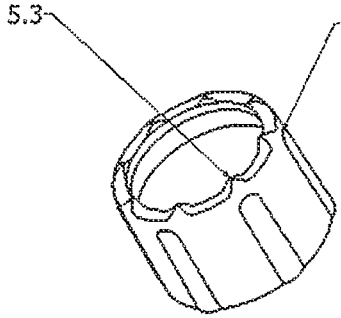
FIG 5B
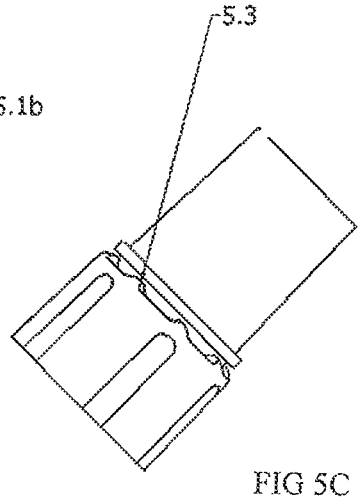
FIG 5C
FIG 6A
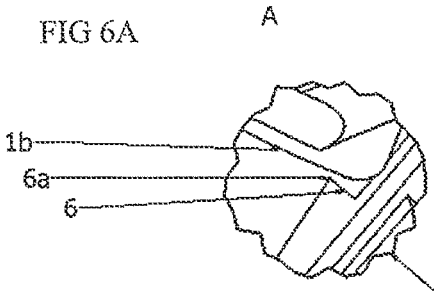
FIG 6
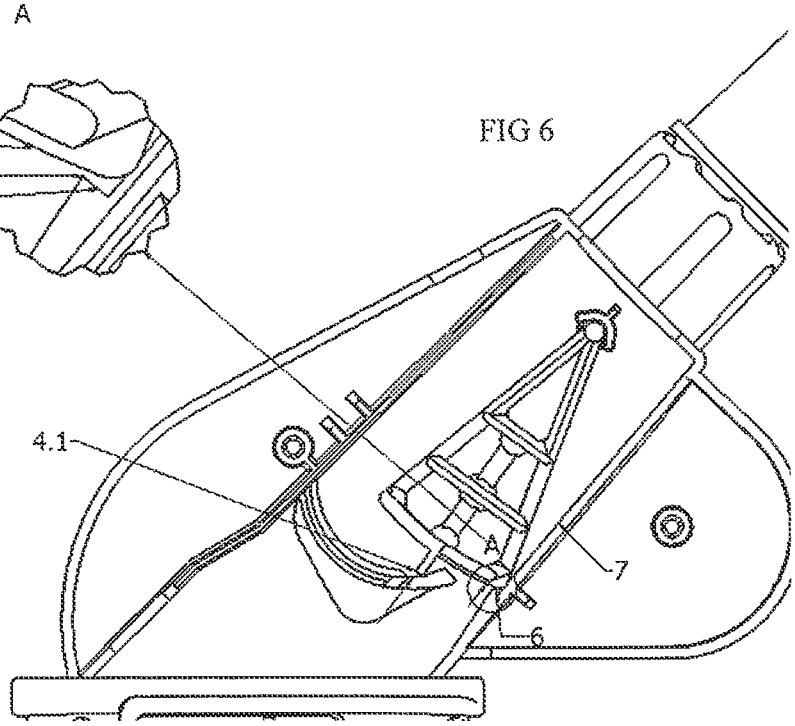

FIG 7A
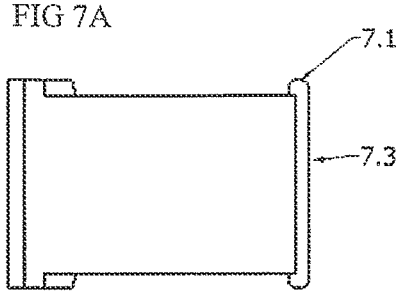
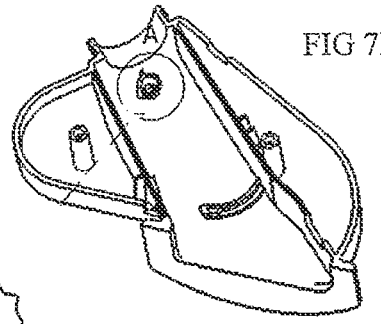
FIG 7B
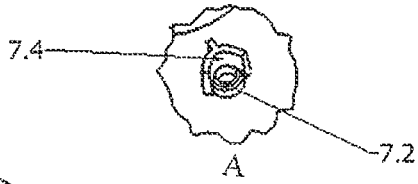
FIG 7C
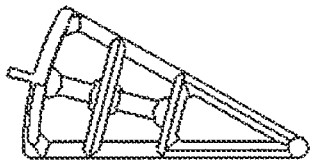
FIG 7D
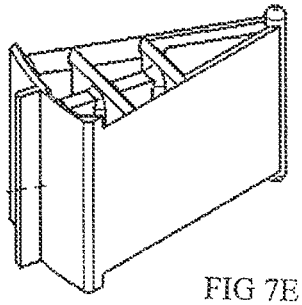
FIG 7E
Fig 8
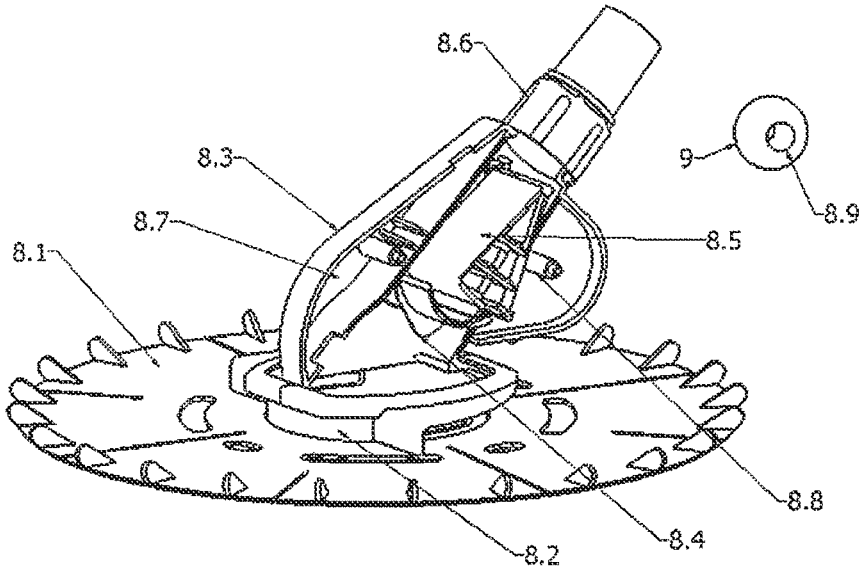

SWIMMING POOL CLEANER

CROSS REFERENCE TO RELATED APPLICATION

This application is the U.S. national phase of International Application No. PCT/IB2007/050385 filed on Feb. 6, 2007 and published in English on Aug. 14, 2008 as International Publication No. WO 2008/096205 A1, the contents of which are incorporated herein by reference.

BACKGROUND OF THE INVENTION

Swimming pool cleaners in various guises exist, each one sporting features claiming to be superior to the other. The purpose of this invention is to produce a cleaner that is not only more compact than the existing cleaners of this configuration but also quieter and more durable.

Typically, cleaners of this configuration use some or other valve to interrupt or partially interrupt the flow of water through the said valve. This interruption in the flow of water will cause the cleaner to jump forward in a stepwise manner following each cycle of valve interruption.

Some cleaners on the market rely on a flexible valve membrane ref U.S. Pat. No. 4,642,833 Stoltz; Andries J. (Pretoria, ZA), Kallenbach; Dieter H. F. (Sandton, ZA) to interrupt flow while others rely on a rigid valve member ref U.S. Pat. No. 4,133,068 Hofmann.

Both of these valves have advantages and disadvantages. Typically the flexible valves will be better in Sandy environments and quieter in operation, whereas the harder valves will be more durable though noisier.

What all these and current valve interruption flexible disk type cleaners have in common is fitment of a rigid tube in between the valve and cleaner hose. This tube is necessary to 'tune' the interruption cycle so the valve does not cycle too slow or fast. Typically the longer the rigid tube the slower the valve will cycle. In other cleaners, specifically the partial water interruption cleaners, twin tubes are of sufficient length to create necessary shockwave effect in each tube to move the cleaner forward (ref U.S. Pat. No. 4,023,227 Chauvier). The necessity of this tuning tube makes the current group of pool cleaners seem noisy and bulky in appearance.

Another negative aspect of rigid 'tuning' tubes is that by creating a shockwave within the tubes the water-hammer effect creates a momentarily reverse flow situation thereby slowing down flow and debris pick-up.

The scope of this invention is to combine the best properties of each type i.e. reliability of the hard valve and low noise levels of the diaphragm type valves in a much smaller package.

While a similarity may exist between the Hofmann patent and this invention in that both uses an oscillating valve with a means of interruption of flow through a secondary channel the similarity ends there in that Hofmann describes a baffle plate functioning only as a means to restrict flow to the secondary passage.

Furthermore the partition member in the Hofmann patent has a serious drawback in that the cleaner would block very easily with debris, even a small grain of sand has proved to stop the cleaner when it entered the secondary channel, this is because Quote 'The shape of the valve protruding the peak enables the space between the valve and partition member 22 to remain substantially constant as the valve moves between its terminal positions and is also symmetrical'

Because the shape is constant and the partition member and valve surfaces are very close together throughout the valve oscillation process the smallest piece of debris entering between the two surfaces would become wedged and stop the unit.

For this invention an insert also referred to as a flow-control-diverter is provided to perform a multi task operation in that it functions as a means:

1. Control flow between a primary and secondary channel to effectively negate the use of a rigid or tuning tube between valve and hose.
1. In conjunction with a secondary feature create hydraulic valve cut off for extremely quiet operation and durability
1. Guide debris by means of guide-ribs to primary flow channel
1. Create a plenum chamber of sufficient volume between insert and valve to allow flow and debris entering the secondary channel to proceed uninterrupted to the outlet
1. Interrupt flow This invention is unique in that the tuning of the valve cycle frequency does not depend on the length of a rigid or tuning tube at the outlet side of the valve in-between the valve and hose but rather on a flow pattern created by diverting and regulating flow to the primary and secondary channels on the inlet side of the valve.

The design differs from other designs of this type that focus on restricting flow to the secondary channel to a maximum in that it actually specifies a fair amount of flow volume be diverted to the secondary channel.

As a consequence of this a larger volume of water will flow through the cleaner under all operating conditions in comparison with the more restrictive means of other designs Correctly balanced the cleaner will although it uses a hard material valve to interrupt the flow of water be quieter even than a flexible membrane valve.

This low noise levels are achieved by creating a 'water cushion' effect so the valve will in closing return to open before it actually makes contact with a hard surface in the body housing.

In the open position valve may make brief contact with the housing but the force is so low that it can barely be heard under normal operating conditions.

In the preferred embodiment debris is diverted into a main (primary) flow channel whereas a secondary channel will allow mostly water flow and smaller debris through.

To prevent large debris from entering the secondary channel an insert with integral guides is provided to divert debris to the main channel, although smaller debris may from time to time pass through the secondary channel.

Furthermore the insert is devised to sufficiently interrupt flow to the main channel when valve closes against it to create a shockwave to propel cleaner in a stepwise manner.

The insert is shaped as to create an enlarged gap between the valve inlet face and insert as valve returns to open position so as to allow debris entering the secondary channel to progress freely to outlet.

In conjunction with the insert hydraulic cut-off technology creates extremely quiet operation Valve has cutaway sides and hinged mechanism for improved durability and debris digestion.

The invention also comprises of other unique features such as anti-blocking swivel, split outer housing integrated with inner housing kept etc.

SUMMARY OF THE INVENTION

According to this invention a cleaner comprising of the following parts:

1. Disk for adhesion to pool surfaces.
1. Shoe for disk fitment and traction.
1. Valve member for interruption of flow.
1. Swivel.
1. Float and weight for balance.
1. Housing with insert

DESCRIPTION OF THE DRAWINGS

Drawing FIG. 1 illustrates a sectional side view of the inside of the cleaner housing with the valve in the open position and preferred debris diverter.

Drawing FIG. 2 illustrates the same side view but this time with the valve in the closed position, enlarged cutout A (FIG. 2A) depicting close up of encircled area.

Drawing FIGS. 3 and 3A illustrate the preferred flow control debris diverter with half moon guides.

Drawing FIGS. 4 and 4A illustrate a further embodiment of the flow control diverter.

Drawing FIGS. 5A-C illustrate the anti blocking swivel.

Drawing FIG. 6 illustrates the water-buffer edge and relationship of valve thereto in close position with cutout A (FIG. 6A) depicting close, up of water buffer step.

Drawing FIGS. 7A-E illustrate the valve with the cutaway sides and hinge mechanism.

Drawing FIG. 8 illustrates a preferred embodiment of the cleaner.

DETAILED DESCRIPTION OF THE PREFERRED EMBODIMENT

In FIG. 1 the valve is shown in an open position. Valve member 4 pivots in hinge 10. On closer examination of FIG. 7 close up of the hinge can be seen.

Waterflow will enter the valve chamber from inlet intake orifice 1 through primary channel A 1 see arrows A FIG. 1 then proceed to outlet 2 at swivel 3 that connects to the hose and filtration pump When water flow through primary channel; see arrows A, the flow pattern acting on the valve surfaces will rotate the valve member to the closed position shown in FIG. 2.

With valve in closed position flow is sufficiently interrupted by valve protrusion member 4.1 closing on flow-control-diverter plate 5 thereby creating a shockwave effect to move cleaner in a stepwise manner.

Since valve can not rotate any further, waterflow will now follow the secondary path, see arrows FIG. 2, which will move the valve to open position FIG. 1. This process repeats itself Flow-control-diverter 5, functions as a tuning plate to stabilize and control the valve pulse frequency i.e. oscillating speed thereby omitting need for a rigid tube section at the outlet side of the valve.

Generally by having the flow-control-diverter plate decrease the intake orifice 1 through the main channel the faster the pulse frequency and vice versa.

The flow control diverter plate FIG. 3, 3.1 also determines the size of the intake orifice 3*a* between plate 3.1 and valve inlet face 3*b*.

By increasing and decreasing the orifice size 3*a* between flow control plate and valve inlet face 3*b* the valve travel distance towards the open position can be determined.

It speaks for itself that the valve can only rotationally oscillate to the open position till contact is made with the casing face 3.3; however the preferential orifice size is such that the valve barely touches the casing to minimize wear and noise. 3.4 FIG. 3 depict the enlarged plenum zone.

Another feature of the flow-control-diverter plate is to function as a debris diverter by diverting debris to the primary channel.

As can be seen in FIG. 3, 3.1 the flow-control-diverter plate has numerous projected members 3.2 aligned towards the primary channel to fulfill this function.

The projected members are spaced apart with half moon gaps 3.5 inbetween to allow for sufficient flow to secondary channel while fulfilling their main function as debris guides.

While the circular design of the embodiment shown is preferred the flow-control-diverter plate can also be flat 11 FIG. 4 as long as it is placed so that plate inside face 16 FIG. 4 forms an angle to valve protrusion 4.1 FIG. 4, such angle as to allow for sufficiently large plenum zone 13 FIG. 4 to exist between said plate and valve secondary inlet face 15 FIG. 4 as to allow debris through passage.

Also note position of valve protrusion 4.1 FIG. 1 in relation to flow control diverter 5 FIG. 1 when valve in open position, sufficient gap exist between the two members to allow for debris to pass It is therefore of vital importance that the flow-control-diverter plate allows for enlargement of the gap between the valve protrusion 4.1 FIG. 4 and the flow control plate inside surface 16 FIG. 4 as valve rotates to the open position. This feature will allow debris entering through inlet orifice 3*a* FIGS. 3 and 3.5 FIG. 3 to proceed through secondary channel to outlet unhindered.

Ideally valve protrusion member 4.1 FIG. 2 should not make physical contact with diverter-flow control plate 5 FIG. 2 when valve in closed position see FIG. 2 as this will increase wear on both parts. A Gap between 0 mm and 3 mm should sufficiently interrupt flow to move cleaner in stepwise manner Flow-control-diverter 5 FIG. 2 therefore performs multiple functions by determining the pulse frequency and valve travel as well as managing debris through both primary and secondary channels.

Generally larger debris will proceed through primary channel A1 FIG. 1 due to the efficiency of the debris guides while smaller debris may occasionally enter secondary channel B1 FIG. 2.

a Water buffer step feature 6 FIG. 6 placed on the intake side of the valve inlet face 1*b* FIG. 6 so valve closes with inlet face 1*b* in close proximity generally within 0.1-2 mm to edge 6*a* FIG. 6, momentarily compress water when valve in the closed position to create hydraulic flow cut-off, i.e. valve will return to opening stroke without physically hammering the casing side.

This hydraulic cut off equates to very quiet valve oscillation, surpassing even the low noise level of diaphragm type cleaners.

Increasing the distance between valve top end 1*b* FIG. 6 and step 6 will subsequently increase noise level as hydraulic cut off will disappear and valve will make contact with surface 7 FIG. 6

FIG. 5 illustrates the preferred swivel design; Male FIG. 5.1 and female FIG. 5.2 parts clip together for ease of assembly, importantly all inside surface of the assembled swivel is chamfered to enlarge towards the inside of the swivel to allow for small particles such as sand to proceed through the swivel into the main outlet.

As can be seen female part has protrusions FIG. 5.3 where it makes contact with a flat surface 5.1*b* on the male part 5.1. Once assembled any debris caught inbetween the two parts will fall out as swivel rotates. The design also has the added benefit that friction is minimized due to the decrease in surface contact between the two parts thereby creating a very smooth swivel.

In FIG. 7 preferred valve member is illustrated, by narrowing the sides of the valve behind the inlet face smaller debris will not get caught between valve sides and casing sides.

Valve integral protrusion 7.1 slides into cavity 7.2 and surface 7.3 is supported by 7.4

FIG. 8 illustrates a cutaway of the preferred embodiment of the cleaner, as can be seen in the drawings the housing design is of a simple two piece clip together design to assemble in seconds, without need of screws or fasteners, the swivel 8.6 and shoe 8.2 keeps the whole unit together. 8.1 illustrates the flexible membrane (disk) 8.3 right housing, (left housing not shown) 8.4 flow control diverter, 8.5 valve, 8.7 flotation cavity, 8.8 sliding weight pin, 9 weight, 8.9 cavity to slide over pin 8.8

What I claim is:

1. An automatic swimming pool cleaner comprising:

a. a body;

b. a valve positioned within the body; and b. a diverter plate (i) positioned within the body proximate the valve and (ii) comprising a plurality of projecting members separated by at least one gap through which at least some debris entrained within fluid entering the cleaner may pass.

2. An automatic swimming pool cleaner according to claim 1 in which the diverter plate is scalloped.

3. An automatic swimming pool cleaner according to claim 1 in which (a) the body has an inlet, an outlet, and a side wall and (b) the valve and the diverter plate are positioned between the inlet and the outlet, further comprising a step projecting from the side wall, with the diverter plate and the step restricting flow of fluid between the inlet and the outlet.

4. An automatic swimming pool cleaner according to claim 3 in which (a) the valve pivots between an open position and a closed position in use and (b) the step is configured so that the valve, when in the closed position, returns to the open position without hammering the side wall.

5. An automatic swimming pool cleaner according to claim 1 further comprising a swivel attached to the body, the swivel comprising:

a. a male part having a flat surface; and b. a female part having protrusions in contact with the flat surface.

6. An automatic swimming pool cleaner comprising:

a. a body comprising an inlet, an outlet, and a side wall defining an interior region;

b. a valve positioned within the interior region of the body and movable to a first location adjacent the side wall;

c. a diverter plate (i) positioned within the interior region of the body proximate the valve and (ii) through which at least some debris entrained within fluid entering the cleaner may pass; and d. a step (i) comprising (A) a first surface formed so as to project from the side wall into the interior region of the body between the inlet and the first location and (B) a second surface (1) formed at an acute angle to the side wall, (2) projecting from the side wall into the interior region of the body between the inlet and the first location, and (3) intersecting the first surface and (ii) which, together with the diverter plate, restricts flow of fluid between the inlet and the outlet.

7. An automatic swimming pool cleaner according to claim 6 in which the second surface is longer than the first surface.

8. An automatic swimming pool cleaner according to claim 6 in which all of the second surface is between the inlet and the first location.

* * * * *